United States Patent [19]

Kapash

[11] 3,994,784

[45] Nov. 30, 1976

[54] METAL REPLICATION OF GLASS DIES BY ELECTROFORMING

[75] Inventor: Richard J. Kapash, San Rafael, Calif.

[73] Assignee: Optical Sciences Group, Inc., San Rafael, Calif.

[22] Filed: Apr. 1, 1976

[21] Appl. No.: 672,750

[52] U.S. Cl. ..... 204/6; 204/297 W

[51] Int. Cl.[2] ..... C25D 1/10; C25D 1/20; C25D 17/06

[58] Field of Search ..... 204/6, 7, 4, 281, 297 R, 204/297 W

[56] References Cited

UNITED STATES PATENTS

| | | | |
|---|---|---|---|
| 1,010,638 | 12/1911 | Kitchen | 204/297 W |
| 2,372,567 | 3/1945 | Graham et al. | 204/297 W |
| 2,441,747 | 5/1948 | Beshgetoor | 204/6 |
| 2,544,250 | 3/1951 | Benard | 204/16 |
| 3,414,502 | 12/1968 | Porrata et al. | 204/15 |
| 3,506,887 | 4/1970 | Gutteridge | 204/15 |
| 3,632,695 | 1/1972 | Howell | 204/6 |

*Primary Examiner*—T. M. Tufariello
*Attorney, Agent, or Firm*—Harris Zimmerman

[57] ABSTRACT

In a process for metal replication of Glass dies, the cleaned die is secured in a cavity of a fixture, and a thin masking diaphragm is placed over the die and fixture to expose only the die surface to be replicated. A vacuum is applied through passages in the fixture to secure the diaphragm. The diaphragm-die surface is silvered to render it conductive, and the fixture is immersed in an electroplating bath. After sufficient buildup of electrodeposited material, the fixture is removed from the bath. The metal replica is then removed from the die to reveal a surface which includes an exact replica of the glass die master.

6 Claims, 7 Drawing Figures

METAL REPLICATION OF GLASS DIES BY ELECTROFORMING

BACKGROUND OF THE INVENTION

It is well known in the optical arts that optical surfaces are most perfectly formed when the optical material is glass. The single crystalline structure of glass permits grinding, lapping and polishing of the surface to a degree of perfection which can be measured in terms of single wave lengths of light. In this manner highly accurate lenses are produced.

In the present state of the art these glass lenses are used as master dies in various replication processes. One such process is the production of thermosetting polycarbonate lenses which are widely used in presecription eyeglasses. These glass dies must be used because machined metal or plastic dies cannot approach the optical quality of the glass surface. The polycarbonate curing process requires 24 hours with the result that many identical glass dies are required for volume production.

Unfortunately, the plastic replication process is very abusive of the delicate optical glass. The thermal shock due to the heat involved in the thermosetting process often cracks the master. A common occurrence is that the plastic will not separate from the glass die, and wedges and hammers must be used to effect separation. Such treatment results in chips and scratches in the glass master, rendering it useless as a die. These failures of the glass masters represents a significant cause of production problems in plastic lens manufacturing, and an important cost factor.

SUMMARY OF THE INVENTION

The present invention discloses a process whereby the optical glass master dies may be replicated in a nondestructive manner by electroplated metal. In this manner the optical quality surface of the master is transferred to the metal copy, which is then used in lens production. The glass master need not be involved in the lens production process, thereby greatly extending its life and limiting its gradual degradation.

The process involves cleaning the glass master die and placing it in a recess in a fixture, optical side out. A mylar diaphragm is then placed over the fixture, with an aperture in the diaphragm disposed directly over the optical surface. A vacuum is applied through passages in the fixture to pull the diaphragm tightly against the optical surface, and this vacuum is maintained during the ensuing procedures.

The diaphragm-optical surface is then treated with stannous chloride and rinsed, and is then sprayed with a silver coating to render the surface conductive. The fixture is then immersed in a nickel sulfamate electroplating tank, and the silver surface is connected to the positive terminal of a DC power supply. Nickel is deposited on the conductive surface, thereby replicating the optical surface as well as a portion of the diaphragm surface. The diaphragm is required to prevent any deposition of nickelon areas of the fixture or glass master which would interfere with the replicated optical surface or which would render difficult the separation of the nickel copy from the fixture, and is also necessary to provide a smooth, continuous electrical path from the fixture to the glass surface once the silver is applied. The fixture is then removed from the electroplating bath, and the nickel mass, which includes the replicated optical surface, is easily removed from the fixture. The nickel optical replica may then be used as is for lens production, thus forming a metal die for plastic lens production which is far more durable than the glass master. The glass master may then be reserved for use only when the nickel die is damaged and must be replaced. The nickel replica may also be used as a die master to form sub-master dies for the lens casting process.

THE DRAWING

DESCRIPTION OF THE PREFERRED EMBODIMENT

The present invention generally comprises a process for forming metal replicas of highly machined and polished surfaces which could not be easily formed as a metal original. In the preferred embodiment of the invention the master surface which is replicated is an optical quality glass die. However, those skilled in the art will appreciate that the process of the present invention may be employed in related fields such as microcircuit manufacturing.

Figure 1:
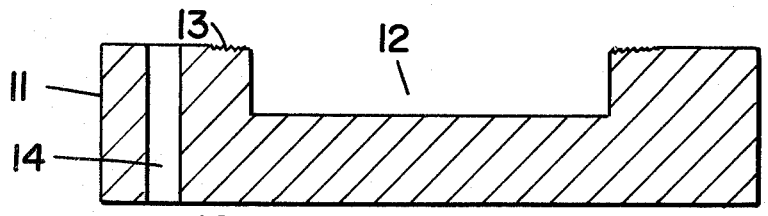
FIG. 1 is a cross-sectional elevation of the fixture of the present invention.

As shown in FIG. 1, the present invention provides a fixture 11 for supporting a glass master die. The fixture is provided with a centrally disposed annular receptacle 12 in which the glass master is received. A roughened annular surface is formed adjacent to and concentric to the receptacle for purposes to be explained in the following. Extending through the fixture to the upper surface thereof is a vacuum passage 14.

Figure 2:
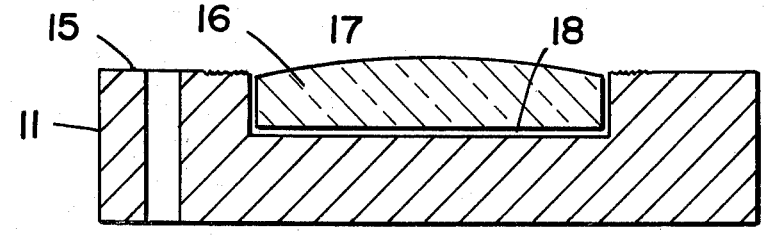
FIG. 2 is a cross-sectional view of the fixture of the present invention in which the optical glass master is secured.
Figure 3:
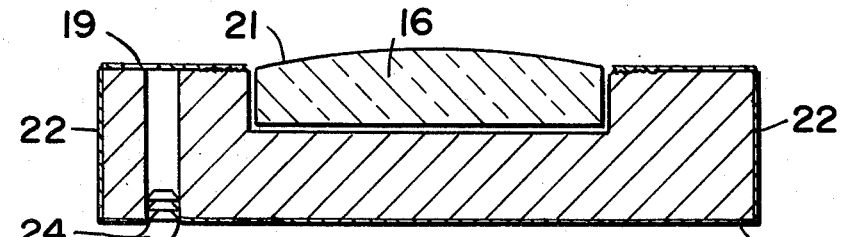
FIG. 3 is a cross-sectional view of the glass die in the fixture, with the diaphragm secured thereto.
Figure 4:
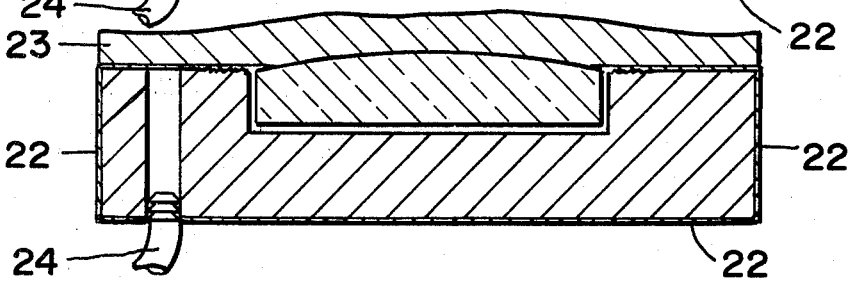
FIG. 4 is a cross-sectional view of the invention as in FIG. 3, shown with electro-deposited metal thereon.

With reference to FIG. 2, a glass master die 16 is placed in the receptacle 12 of the fixture. The die 16 comprises a generally disk-like glass member which has a diameter slightly smaller than the diameter of the receptacle. The die 16 includes an upper concave surface 17 which has been ground, lapped and polished to optical standards. The glass die may be secured in the receptacle by means of an adhesive layer 18, or the vacuum applied subsequently may suffice to retain the die. It may be appreciated that in the case of oval or other non-circular dies, the receptacle will be configured to conform thereto. In any case the upper circumferential edge of the glass die is substantially flush with the surfaces 13 and 15, and the depth of the die and the receptacle must be chosen for this relationship.

Next a diaphragm 19 is placed over the surfaces 15 and 13 of the fixture. The diaphragm includes an aperture 21 therein which is slightly smaller than the diameter of the optical surface 17 so that only the surface 17 protrudes. In the preferred embodiment the diaphragm comprises a mylar sheet which is provided with a release agent such as a Saran coating on the upper surface thereof. A vacuum hose 24 is secured in the vacuum passageway 14, and a vacuum is applied therethrough to pull the diaphragm tightly onto the glass die and the roughened surface 13. If the fixture is formed of a conductive material such as stainless steel, platers tape 22 or other masking material is applied to all surfaces of the fixture on which electrodeposition is undesirable. Copper tape may be applied to portions of the diaphragm 19 to provide good electrical contact for the plating process, or holes may be provided in the diaphragm through which contact may be made between the silver and the fixture.

After the entire fixture is given a general cleaning, a number of procedures are used to clean the surface 17 of the glass die to permit the optimum transfer of the optical perfection of the master to the metal replica. The surface 17 is cleaned with magnesium dioxide or a slurry of precipitated chalk solution. After it is rinsed it is sprayed with a detergent solution and rinsed again. Nitric acid is then poured onto the surface 17 to remove any oxides, and quickly rinsed off before it can react with the copper tape on the fixture. The surfaces of the diaphragm 19 and the die 17 are then immersed in a stannous chloride solution to prepare them for silvering, and to provide good adhesion of the silver to the glass surface.

These surfaces are again rinsed, and then sprayed with a silver solution to deposit a conductive silver film on these otherwise non-conductive surfaces. The solution may comprises ammoniacal silver nitrate or other compounds known in the art. The spraying process must be uniform to produce a thin conductive film with no buildup which would distort the replica surface. The unit is then rinsed with water once more, and inspected to insure that silver has not adhered to surfaces on which plating is undesirable.

A positive electrode from a DC power supply is then secured to the conductive surface just formed, either by means of a contact screw in the fixture or a contact clamp (neither shown). With a vacuum still applied to the fixture it is immersed into a nickel sulfamate plating tank, where nickel is electrodeposited onto the silvered surface. Air agitation and other means known in the art may be required to prevent gas bubble buildup on the silvered surface, and to promote uniform plating thereon.

Figure 5:
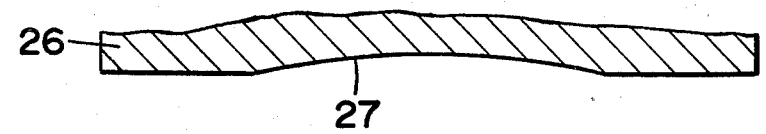
FIG. 5 is a cross-sectional view of the completed metal replica of the glass master.

After the electrodeposition 23 has progressed to the point of formation of a structurally sound replica 26, shown in FIG. 5, the fixture is removed from the tank and rinsed, and the replica and diaphragm are removed from the fixture. The replica includes the replicated optical surface 27, which may then be used to cast exact copies of the optical surface 17. It may be noted that the mechanical bond between the electrodeposited nickel and the silver surface is very strong, but the silver-glass bond is weak. The nickel replica separates relatively easily from the glass die.

Figure 6:
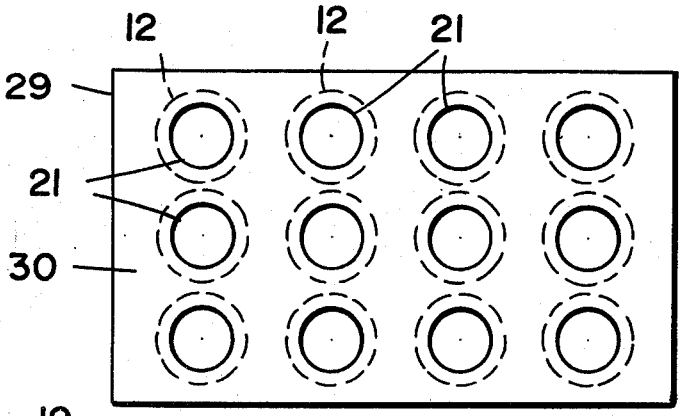
FIG. 6 is a plan view of a multiple die production fixture according to the present invention.

In a full production situation it is advantageous to replicate a plurality of glass master dies simultaneously. As shown in FIG. 6, a fixture 29 is provided for this purpose. The fixture 29 includes a plurality of receptacles process is as described in the foreagoing, including the use of a vacuum to hold the diaphragm, buy many replicas may be produced in the same amount of time as is required to produce one, thereby saving labor costs.

Figure 7:
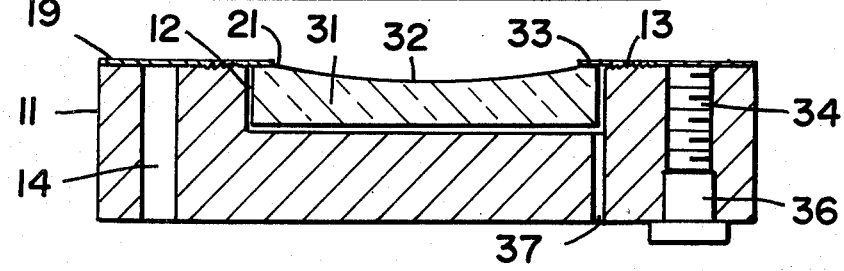
FIG. 7 is a cross-sectional view of the fixture of the present invention, shown in use with a concave glass master.

Using the process of the present invention it is equally possible to replicate a negative optical surface. As shown in FIG. 7. the fixture 11 is provided with the receptacle 12 and the vacuum passage 14, as before. The glass master die 31 is provided with a negative optical surface 32, and is secured in the receptacle 12. It should be noted that the die is also provided with a flat annualr surface 33 concentric about the concave surface 32. The diaphragm 19 is placed over the fixture as described in the foregoing with the edge of the aperture 21 resting on the flat annulus 33. The surface 33 is necessary to provide proper sealing of the diaphragm. The process proceeds as before.

Also shown in FIG. 7 is another vacuum passage 37 in the fixture, extending from the lower end thereof to the receptacle. This or other vacuum passages may be disposed in various locations in the fixture, as required by the configuration of the glass die, whether concave or convex. The fixture may also be provided with at least one tapped hole 34, which is normally sealed with a plug 36. Should removal of the nickel mass from the fixture prove difficult due to electrodeposition in crevices or the like, these holes may be unplugged and screws inserted therein. Since the holes 34 extend to the upper surface of the fixture, the screws may be used as jacks to force the nickel replicas away from the fixture.

I claim:

1. A process for forming an exact replica of a surface of a non-conductive die, comprising the steps of: placing the die face up in a receptacle in a fixture; placing a diaphragm over said fixture, said diaphragm inclduding an aperture therein aligned with said surface of said die, said aperture being slightly smaller than said surface of said die and concentric therewith; applying a vacuum to the underside of said diaphragm through passages in said fixture to secure said diaphragm thereto and to said surface of said die in sealing fashion; applying a conductive coating to said diaphragm and said surface of said die; electrodepositing material on said conductive coating to form a replica of said surface of said die; and stripping said electrodeposited material from said diaphragm and said die.

2. The process according to claim 1, wherein said step of applying a conductive coating includes spraying said diaphragm and said die surface with a silver solution.

3. The process according to claim 1, wherein said diaphragm comprises a Mylar sheet.

4. The process according to claim 3, wherein said Mylar sheet is provided with a polyvinylidene chloride film on the upper side thereof.

5. The process accordidng to claim 1, wherein said surface of said die comprises a polished and lapped optical surface.

6. The process according tc claim 1, wherein said step of electrodepositing material includes the steps of connecting said conductive coating to the positive pole of a DC power supply, and immersing said fixture in a nickel sulfamate plating bath.

* * * * *